United States Patent [19]

Unger et al.

[11] Patent Number: 4,950,401

[45] Date of Patent: Aug. 21, 1990

[54] CENTRIFUGAL SEPARATOR

[75] Inventors: Peter Unger, Stockholm; Eric Westberg, Lidingö; Lars Ehnström, Tullinge, all of Sweden

[73] Assignee: Alfa-Laval Separation AB, Tumba, Sweden

[21] Appl. No.: 314,762

[22] PCT Filed: Sep. 7, 1987

[86] PCT No.: PCT/SE87/00399

§ 371 Date: Feb. 2, 1989

§ 102(e) Date: Feb. 2, 1989

[87] PCT Pub. No.: WO88/01907

PCT Pub. Date: Mar. 24, 1988

[30] Foreign Application Priority Data

Sep. 12, 1986 [SE] Sweden ..... 8603850

[51] Int. Cl.[5] ..... B04B 5/00

[52] U.S. Cl. ..... 210/360.1; 494/18; 494/56; 494/84

[58] Field of Search ..... 494/18, 27, 45, 47, 494/56, 66, 84; 210/360.1, 380.1, 382

[56] References Cited

U.S. PATENT DOCUMENTS

| | | | |
|---|---|---|---|
| 3,817,449 | 6/1974 | Westberg et al. | 494/27 |
| 4,356,958 | 11/1982 | Kolobow et al. | 494/43 |
| 4,372,484 | 2/1983 | Larsson et al. | 494/18 |
| 4,459,169 | 7/1984 | Backhowski et al. | 494/18 |
| 4,778,444 | 10/1988 | Westberg et al. | 494/18 |

*Primary Examiner*—W. Gary Jones
*Assistant Examiner*—Matthew O. Savage
*Attorney, Agent, or Firm*—Davis Hoxie Faithfull & Hapgood

[57] ABSTRACT

The invention concerns a centrifugal separator with a rotor (15), in which a flexible member (28), e.g. a hose, extends a distance along the periphery of the rotor. The hose defines two parallel channels (29, 30), which form a separation chamber in the rotor and extend from the peripheral part of the rotor towards the rotor center; from there axially out of the rotor (15) at one axially directed side thereof, around the rotor to its opposite side and to a point (27) aligned with the rotor axis (C). During the operation of the rotor the hose may be rotated intermittently around its longitudinal axis relative to the rotor body, so that the radially inner and outer walls of the separation chamber are changing places.

8 Claims, 6 Drawing Sheets

CENTRIFUGAL SEPARATOR

Figure 1:
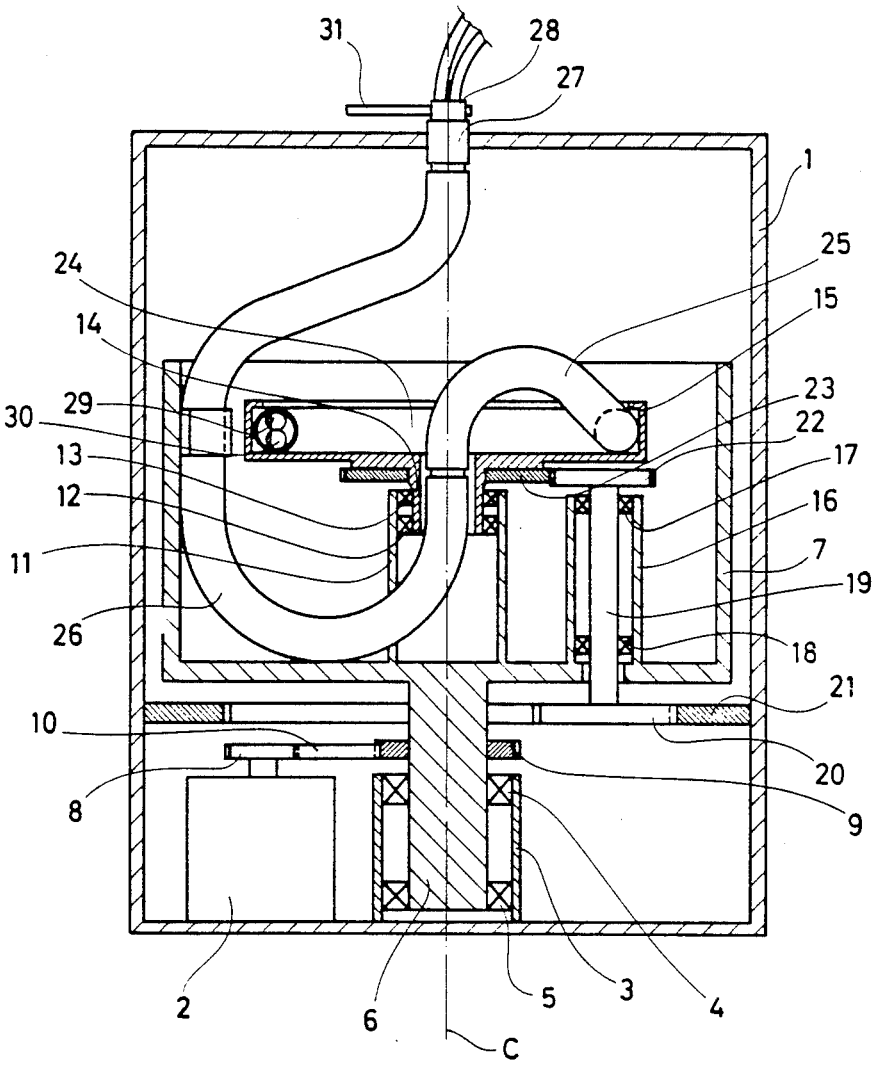

The present invention relates to a centrifugal separator comprising a rotor body, which is rotatable around an axis and has two axially separated ends, an elongated flexible member forming a separation chamber within the rotor at a distance from said axis and being arranged in a cavity in the rotor body, in which it is arranged to rotate together with the rotor body immovable relative thereto, and means for rotating the flexible member around its longitudinal axis relative to the rotor body during the rotation of the latter, the flexible member further forming an inlet channel extending from the axis of the rotor body to an inlet part of the separation chamber, and an outlet channel extending from an outlet part of the separation chamber to the rotor body axis.

In the Swedish patent No. 352 540 there is shown a centrifugal separator of this kind having an axially elongated rotor and a flexible member in the form of an ordinary hose. The hose extends through a cavity of the rotor body from said axis at one end of the rotor body via a peripheral part of the rotor body and back to the axis at the other end of the rotor body.

The centrifugal separator thus known is intended for batchwise centrifugation of a liquid mixture. The mixture may be sucked into the hose from one of its ends, and after completed separation the separated components of the mixture may be removed from the hose one at the time through one of the hose ends.

The object of the present invention is to provide a centrifugal separator of the initially defined kind, which is more suited than the known centrifugal separator for continuous operation, can be given substantially larger capacity and better separation efficiency than this, and enables a very gentle supply and discharge of liquid.

This object is obtained according to the invention in that the separation chamber is elongated and extends with its longitudinal axis in the circumferential direction of the rotor body, that said inlet channel and outlet channel extend from the separation chamber to the same end of the rotor body, and that the flexible member and the inlet and outlet channels defined therein extend out from the last mentioned end of the rotor body and its axis and further around the periphery of the rotor body to a place opposite to the other end of the rotor body at the same axis.

The described extension of the flexible member outside the rotor makes it possible to conduct liquid therethrough to and from the rotor body while it is rotating, without use of a rotational coupling between the rotor and a stationary conduit for liquid. This technique is known per se by for instance by the U.S. patent specifications 3,358,072 and 3,586,413.

In one embodiment of the invention the flexible member is constituted by a hose extending without interruption with a first part from said place outside the rotor body, through said end of the rotor body, to the separation chamber, with a second part within the cavity of the rotor body, said second part forming the separation chamber, and with a third part from the separation chamber through the said end of the rotor body and further back to said place outside the rotor body. In this embodiment both of the hose portions outside the rotor body have to be rotated in opposite directions around their respective longitudinal axes, when the hose portion within the rotor is to be rotated relative to the rotor body.

In a preferred embodiment of the invention, which makes it easier to rotate the flexible member while the rotor body is rotating, the flexible member comprises two channels extending side by side all the way from said place outside the rotor, via said end of the rotor body, to said cavity of the rotor body, in which the two end portions of the channels extend in the circumferential direction of the rotor body and form respective parts of the separation chamber, the channels communicating with each other at their ends within the rotor body.

Preferably the flexible member itself forms the two channels, i.e. the flexible member has the form for instance of a hose with two parallel channels, formed by extrusion.

A centrifugal separator of the above described kind designed in accordance with the invention may be used to separate particles from a liquid supplied to the separation chamber. Then the particles are settling on the surrounding wall of the separation chamber, while the liquid freed from particles is flowing further on and out of the separation chamber. When a predetermined amount of particles has been collected in the separation chamber, they may be removed from the separation chamber, while the rotor body is rotating, through said outlet channel in the following manner. The part of the flexible member forming the separation chamber is rotated 180° around its longitudinal axis, while a liquid is caused to flow through the separation chamber from its inlet part to its outlet part, or reverse. The said surrounding wall of the separation chamber, on which the separated particles have settled, then will be moved so that it is directed radially outwards instead, the particles getting loose from it and being entrained by the flowing liquid out of the separation chamber.

According to a further development of the invention the above described centrifugal separator may be formed for continuous separation of two liquid components of the separation chamber. In that case the flexible member is provided with two different outlet channels, which start from said outlet part of the separation chamber at places situated at different distances from the rotor axis.

The above described rotatability of the flexible member relative to the rotor body may be used in the last described embodiment of the invention for instance in connection with cleaning of the separation chamber during rotation of the rotor body in order to remove particles or other deposits in the separation chamber.

Figure 2:
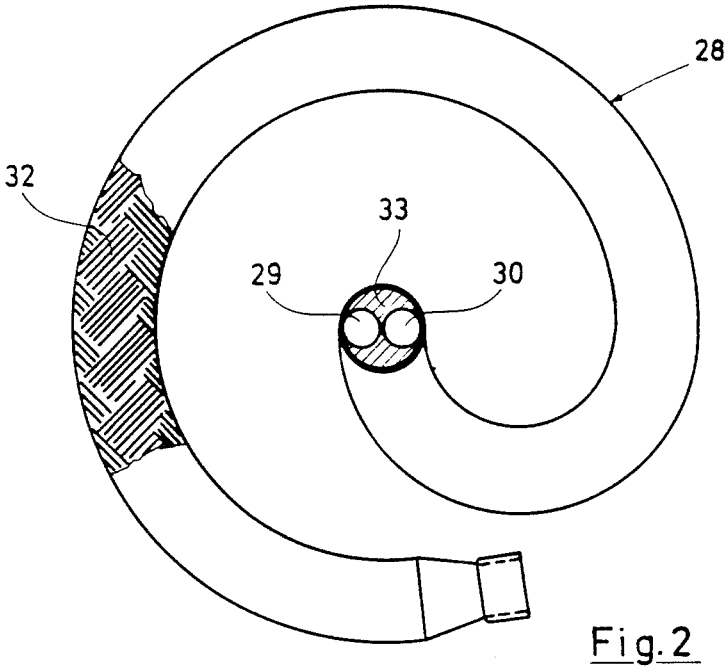
Figure 3:
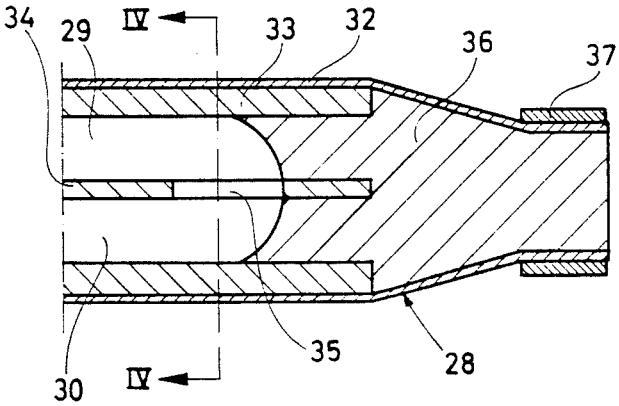
Figure 4:
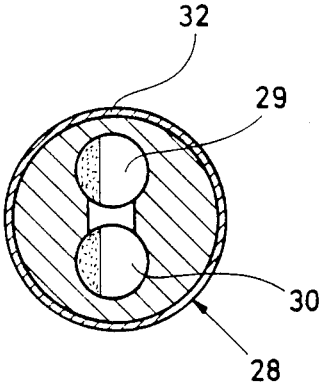
Figure 5:
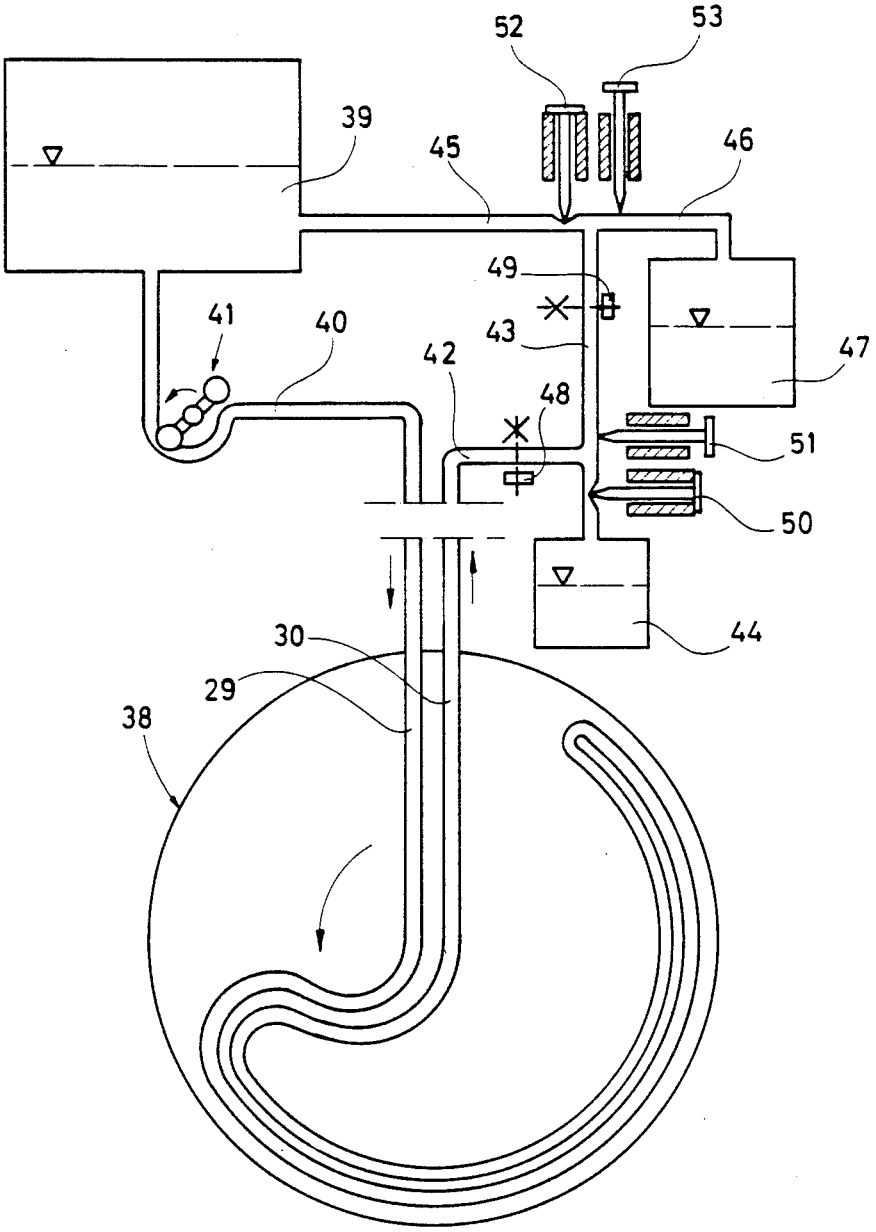
Figure 6:
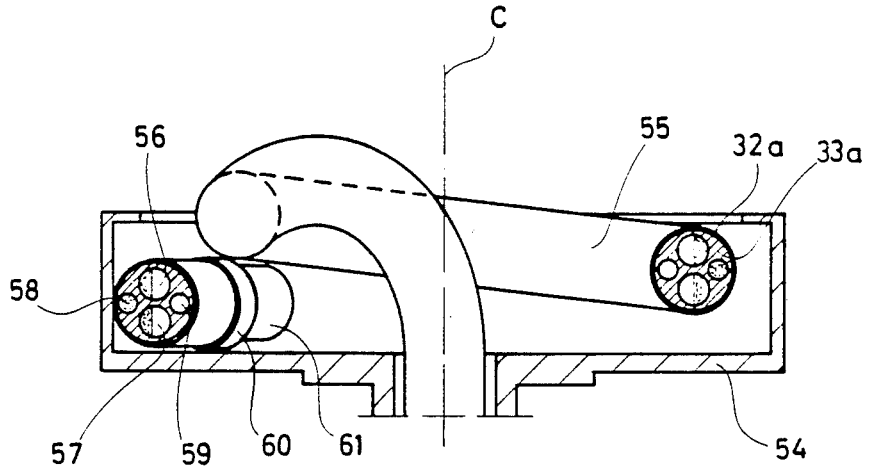
Figure 7:
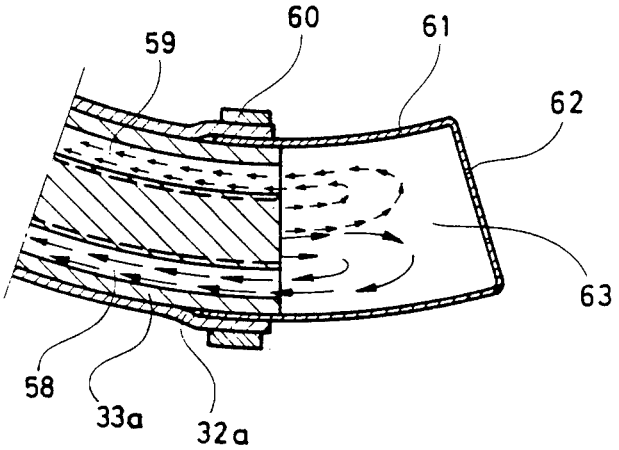
Figure 8:
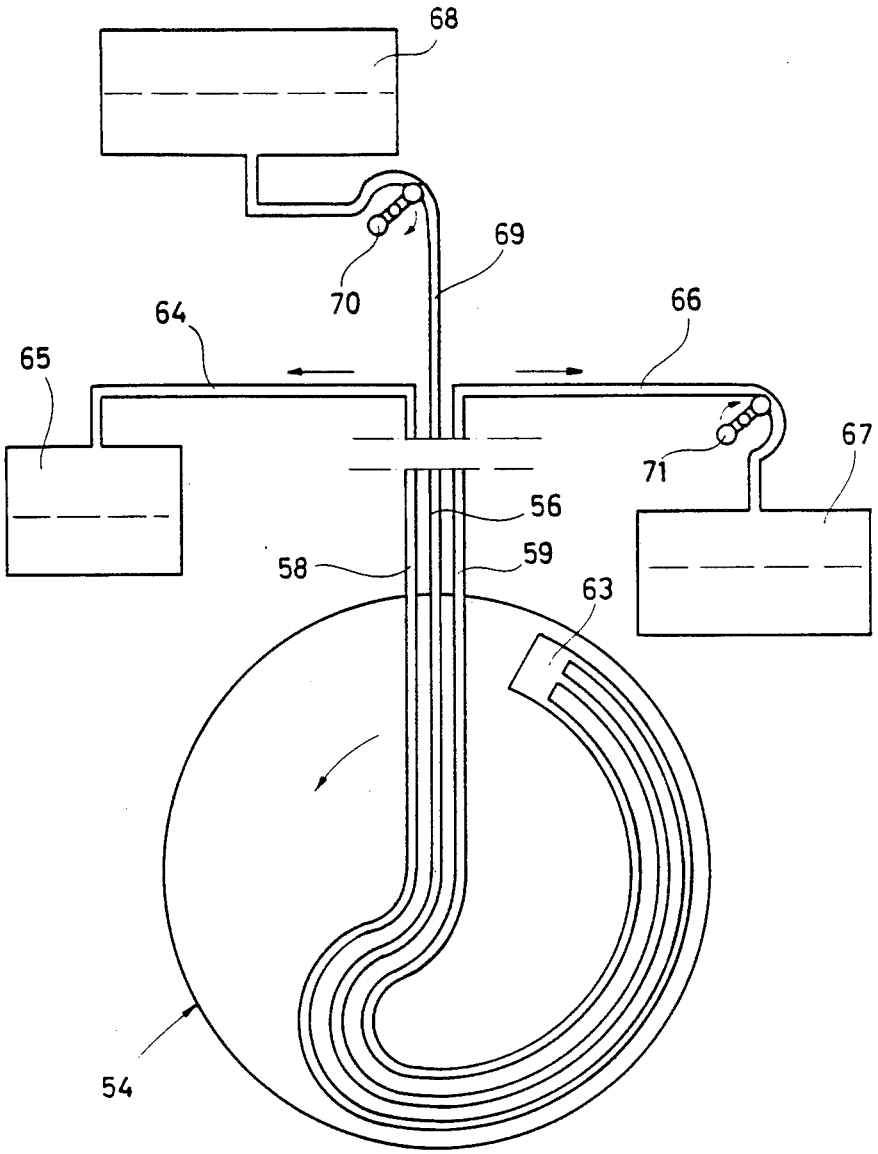
Figure 9:
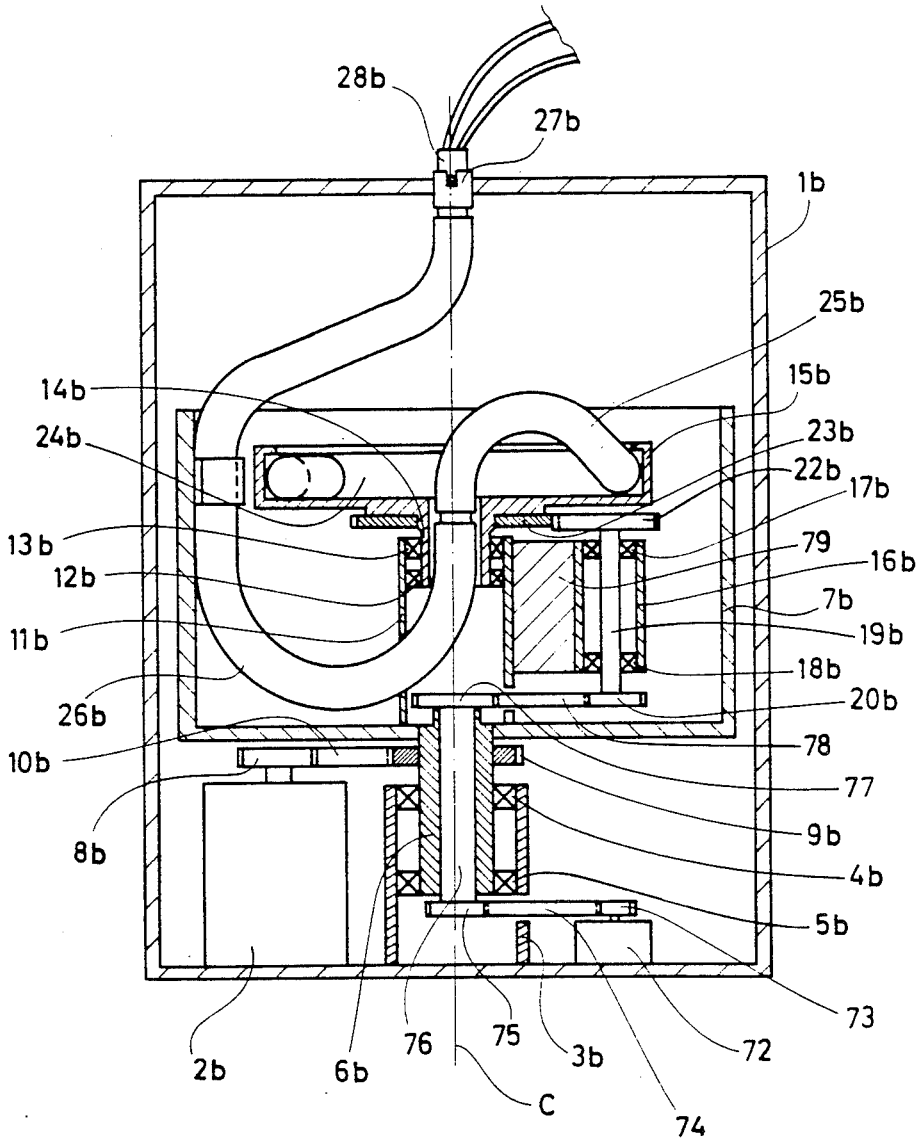

The invention is described in the following with reference to the accompanying drawings, on which FIG. 1 shows a section through a centrifugal separator according to the invention, FIG. 2 shows a part of a flexible member forming a separation chamber in the centrifugal separator according to FIG. 1, FIG. 3 shows a longitudinal section through an end portion of the flexible member according to FIG. 2, FIG. 4 shows a cross section through the end portion of the flexible member according to FIG. 3, FIG. 5 shows schematically a separation plant in which a centrifugal separator according to FIG. 1–4 is included, FIG. 6 shows a section through a part of a centrifugal separator according to an alternative embodiment of the invention, FIG. 7 shows a longitudinal section through an end portion of a flexible member included in centifugal separator according to FIG. 6, FIG. 8 shows schematically a separation plant in which a centrifugal separator according to the alternative embodiment in FIG. 6 and 7 is included, and FIG. 9 shows a centrifugal separator according to a further embodiment of the invention.

In FIG. 1 there is shown a centrifugal separator according to the invention comprising a stationary casing 1, a motor 2 mounted therein and a bearing house 3. The bearing house 3 supports two bearings 4 and 5, wherein there is journalled a vertical spindle 6. The spindle is rotatable around an axis C. On the upper end of the spindle there is mounted an upwardly opening cylindrical container 7. The motor 2 is arranged to rotate the spindle 6 through two gear wheels 8, 9 and a gear belt 10.

Within the cylindrical container 7, coaxially therewith, there is mounted on the container bottom a central sleeve 11. On its inside the sleeve 11 supports two bearings 12 and 13, in which there is journalled a sleeve formed part 14 of a rotor body 15.

Spaced from the axis of the container 7 there is mounted on the container bottom a further sleeve 16. This supports on its inside two bearings 17 and 18, in which there is journalled a vertical shaft 19. The shaft 19 extending down through an opening in the bottom of the container 7 supports below said bottom a gear wheel 20. The gear wheel 20 is in engagement with a gear ring 21 firmly mounted on the inside of the stationary casing 1.

At its upper end the shaft 19 supports a gear wheel 22, which is in engagement with a gear wheel 23 mounted on and coaxially with the rotor body 15.

Within the rotor body 15 there is mounted firmly relative thereto a pipe, which with a first part 24 extends along the periphery of the rotor body and with a second part 25 extends inwards towards the rotational axis C of the rotor.

Within the container 7 there is mounted firmly relative thereto a further pipe 26, which extends from the central end of the pipe part 25 downwards into the sleeve 11, radially out through an opening in the surrounding wall of the sleeve 11, further upwards within the container 7 and again towards the rotational axis C at the upper part of the casing 1.

Firmly mounted in the casing 1 coaxially with the rotor body 15 a short sleeve 27 is arranged opposite to the upper end of the pipe 26.

A flexible member 28 extends from the outside of the casing 1 in through the sleeve 27 and further through the pipe 26 and the pipe parts 25 and 24. Within the flexible member 28 there are defined two channels 29, 30.

The flexible member 28 has a smaller diameter than the sleeve 27 and the pipes 24–26, so that it can be rotated therein around its own longitudinal axis. Above the sleeve 27 there is arranged a member 31 in engagement with the flexible member 28 for rotation thereof relative to the sleeve 27 and the pipes 24–26.

The centrifugal separator shown in FIG. 1 operates in the following manner.

Upon start of the motor 2 the spindle 6 and the container 7 are brought to rotation. Then the sleeve 16 moves in a path around the rotational axis C, the gear wheel 20 by its engagement with the stationary gear ring 21 causing the shaft 19 to rotate relative to the sleeve 16. This rotation is transferred through the gear wheels 22 and 23 to the rotor body 15, which is thus caused to rotate relative to the container 7. The various gear transmissions are calculated in a way such that the rotor body 15 with the pipe parts 24 and 25 will rotate in the same direction and with twice the speed as the container 7 and the pipe 26 around the rotational axis C.

By this arrangement for the driving of the rotor body it will be possible to retain one end of the flexible member 28 fixed relative to the casing 1 and the other end of the same member fixed relative to the rotor body 15 without the flexible member being twisted at the rotation of the rotor body.

Irrespective of rotation or not of the rotor body 15 the flexible member 28 — when desired — may be rotated by means of the member 31 relative to the sleeve 27 and the pipes 24–26. For this it is required, however, that the flexible member has a sufficient stiffness against torsion for such a rotation.

FIG. 2 shows in a plane view the part of the flexible member 28 situated within the rotor body 15. Along a part of the member 28 it is shown that this member is externally provided with a surface layer comprising reinforcement threads 32, for instance of plastic or metal, which are plaited with each other. A certain number of threads thus extend helically with a certain pitch in one direction along the member 28, while the same number of threads — plaited with the others — extend with a corresponding pitch in the other direction along the member 28.

In practice the enforcement threads 32 may form a separate pipe, in which the flexible member 28 is insertable. Such an enforcement pipe is flexible and may be stretched or shortened, so that its diameter is changed in the corresponding degree. The dimensioning of the enforcement pipe is then made so that after the flexible member 28 has been inserted in the enforcement pipe, the latter can be stretched until it gets the same length as the member 28 and in this condition has an inner diameter which is substantially the same as the outer diameter of the member 28. In this way a desired surface engagement is obtained between the enforcement threads and the flexible member, and the enforcement pipe simultaneously can be used for fixing of the ends of the flexible member 28 relative to the casing 1 and the rotor body 15, respectively.

The enforcement threads 32 give the flexible member 28 a large stiffness against torsion, so that it can be rotated around its own longitudinal axis by actuation at one of its ends by the member 31.

In FIG. 3 there is shown a longitudinal section through the end portion of the flexible member 28 which is intended to be situated within the rotor body 15. As can be seen therefrom the flexible member 28 comprises the previously described outer pipe of enforcement threads 32, which surrounds the hose 33, for instance made of soft plastic, in which the two channels 29 and 30 are formed. Between the channels 29 and 30 there is formed a partition 34 of the hose material. This is broken through a short distance from the end of the hose, so that an opening 35 is formed connecting the channels 29 and 30. A closing member 36 is inserted into the hose 33 from its end, and a sleeve 37 is clamping the enforcement pipe firmly on the closing member 36, which is thereby safely kept on site within the hose 33.

In FIG. 4 there is shown a cross section along the line IV–IV in FIG. 3.

In FIG. 5 there is shown a separation plant including a centrifugal separator according to FIG. 1–4. The centrifugal separator is illustrated schematically at 38, while the flexible member 28 (FIG. 1–4) is only illustrated by means of border lines of the channels 29 and 30 extending therethrough.

The separation plant in FIG. 5 further comprises a container 39 for liquid to be supplied to the centrifugal separator 38. The channel 29 through a hose 40 is connected to a bottom outlet of the container 39. A hose pump 41 is arranged to pump liquid from the container 39 to the separator 38.

Through a hose 42 the channel 30 is connected to a conduit 43, one end of which opens into a container 44 and the other end of which is branched into two conduits 45 and 46. The conduit 45 is connected to the already mentioned container 39, while the conduit 46 is connected to another container 47.

Outside the hose 42, which may be transparent, there is arranged a sensing instrument 48, by means of which the degree of turbidity of a liquid flowing through the hose 42 can be sensed. A similar sensing instrument 49 is arranged outside the conduit 43 between the place of connection thereto of the hose 42 and its branch conduits 45 and 46.

On both sides of the place of connection of the hose 42 to the conduit 43 the latter is provided with closing members 50 and 51, respectively. The branch conduits 45 and 46 are provided with similar closing members 52 and 53, respectively. If the conduits 43, 45 and 46 are flexible, the closing members may be constituted by remote controlled hose squeezing means, or the like.

The separation plant according to FIG. 5 with a centrifugal separator according to FIG. 1–4 is intended to be used in the following manner.

While the container 7 and the pipes 24–26 and — with twice the speed — the rotor body 15 are rotated by means of the motor 2, there is pumped from the container 39 by means of the pump 41 a liquid, which is containing particles, through the hose 40 into the channel 29. The channel 29 extends through the flexible member 28 from a point at the sleeve 27 (FIG. 1) above the rotor body 15 to the underneath side of the rotor body, where it extends from the centre of the rotor body therein towards the radially outermost part of the rotor body. At the periphery of the rotor body the channel 29 extends further on a distance along said periphery, possibly several turns around the rotational axis C, to the end portion (FIG. 3) of the flexible member 28. While liquid is flowing in the part of the channel 29 situated remote from the rotational axis C, particles are separated from the liquid. The particles settle on the radially outer wall of the channel 29.

When the liquid has reached the end portion of the flexible member 28, it flows through the opening 35 in the partition 34 and then further through the channel 30. In the part of the channel 30 extending along the periphery of the rotor body 15 particles will settle — as in the channel 29 — on the radially outer wall of the channel. The deposits in the channels 29 and 30 are schematically shown in FIG. 1 and FIG. 4. The said parts of the channels 29 and 30, which extend along the periphery of the rotor body 15, thus form the separation chamber of the centrifuge rotor.

Free from particles the liquid flows further on through the channel 30 and is transferred outside the centrifugal separator, i.e. via a connection which is not shown, to the hose 42. In a starting position the closing members 51 and 53 are open and the closing members 50 and 52 are closed, so that the separated liquid is conducted to the container 47.

After some time of operation particles of such an amount have settled in the channels 29 and 30 of the rotor body 15, that the flow velocity of the liquid through the relevant parts of the channels has increased substantially. At this stage the separation conditions prevailable in the channels 29 and 30 do no longer permit good separation of particles following the liquid from the container 39, why part thereof continues together with the liquid out through the hose 42. This is sensed by means of the sensing instrument 48, and three different things are performed substantially at the same time manually or automatically. Firstly, the closing members 50 and 51 are adjusted so that the first mentioned closing member is opened and the last one is closed. Secondly, the capacity of the pump 41 is increased, so that liquid is caused to flow faster than before through the channels 29 and 30. Thirdly, the flexible member 28 is rotated 180° by means of the stationary member 31 (FIG. 1), so that within the rotor body the radially outer and inner walls of the channels 29 and 30 will change places.

Thereby the separated particles will get loose from the walls of the channels 29 and 30, so that they will be transported by the rapidly flowing liquid out of these channels and through the hose 42 further to the container 44.

As soon as the content of particles in the liquid flowing through the hose 42 has decreased to a predetermined value, which may be sensed by means of the sensing instrument 48, the closing member 50 is closed, whereas the closing member 51 is opened. Simultaneously the capacity of the pump 41 is decreased to a normal value of operation. Possibly, the flexible member 28 is rotated back to its original position. Furthermore, at this stage, the closing member 53 is closed, whereas the closing member 52 is opened.

Initially the liquid flowing through the hose 42 and the conduits 43 and 45 back to the container 39 will contain relatively many particles. As soon as the separation of liquid in the channels 29 and 30 has again become effective and, thus, liquid flowing past the sensing instrument 49 is again free from particles, the closing members 52 and 53 are adjusted manually or automatically so that the separated liquid will flow to the container 47.

In FIG. 6 there is shown schematically in an axial section a centrifuge rotor according to an alternative embodiment of the invention. In a rotor body 54 — similar to the rotor body 15 in FIG. 1 — there is arranged a flexible member 55 extending in the same way as the flexible member 28 in FIG. 1. As in the latter the flexible member 55 comprises a soft hose 33*a* which has an outer layer of interplated enforcement threads 32*a*. Four parallel channels 56, 57, 58 and 59 extend through the hose 33*a*.

In FIG. 7 there is shown in a longitudinal section a short end portion of the part of the flexible member 55 which is situated within the rotor body 54. The end portion is situated at the surrounding wall of the rotor body, and the longitudinal section in FIG. 7 is shown in a plane through the channels 58 and 59. By means of a clamping ring 60 a substantially cylindrical short container 61, which has an end wall 62, is connected with the end portion of the hose 33*a*. The interior of the container forms a chamber 63 in which all of the channels 56–59 in the hose 33*a* are opening.

As can be seen from FIG. 6 the part of the flexible member 55, which extends along the peripheral wall of the rotor body 54, is arranged within the rotor body such that the channels 56 and 57 are situated at the same radius, i.e. at the same distance from the rotational axis C of the rotor body 54. The channel 58 is situated at a somewhat larger radius and the channel 59 at a somewhat smaller radius than the channels 56 and 57.

The centrifuge rotor according to FIG. 6 and 7 is intended for continuous separation of two liquid components with different densities from a mixture thereof. The mixture is to be supplied to the rotor through the channels 56 and 57, and where these extend along the peripheral wall of the rotor body 54 the components will be separated from each other during rotation of the rotor and form two liquid layers in each of the channels, as is illustrated in FIG. 6. The liquid layers flow further on through the channels 56 and 57 to the openings thereof and out into the chamber 63. In this chamber separated heavy component is collected in the radially outermost part of the chamber and separated light component in the radially inner part of the chamber. From these respective parts of the chamber 63 the heavy component will flow into and further through the channel 58, whereas the light component will flow into and through the channel 59.

In FIG. 8 there is shown schematically a plant including a centrifuge rotor of the kind shown in FIG. 6 and 7. The flexible member 55 is illustrated here only by means of the border lines of the channels 56, 58 and 59 present therein. The border lines of the channel 57 coinside with those of the channel 56. The container 61 in FIG. 7 is shown in FIG. 8 schematically as a continuation of the outer border lines of the channels 58 and 59.

In a mechanical sense the centrifugal separator in FIG. 8 is designed in accordance with the centrifugal separator in FIG. 1. In a stationary unit separate from the rotor body 54 the channel 58 is connected to a conduit 64 leading to a container 65. In the same way the channel 59 is connected to a conduit 66 leading to a container 67.

From a container 68 there is starting a conduit 69 which is permanently connected to both of the channels 56 and 57 in the hose 33*a*.

A first hose pump 70 is arranged to pump a mixture of two components to be separated in the centrifuge rotor 54 from the container 68 through the conduit 69 to the channels 56 and 57. A second hose pump 71 is arranged to pump separated light component out of the channel 59 through the conduit 66 to the container 67.

By setting of desired capacities for the pumps 70 and 71 it is automatically obtained a certain flow of separated heavy component through the channel 58 and the conduit 64 to the container 65. A desired degree of separation may be set in this way by means of the hose pumps 70 and 71.

During separation of two liquid components by means of a centrifuge rotor according to FIG. 6–8 the flexible member 55 should not be rotated around its longitudinal axis relative to the rotor body 54. Most liquids being subjected to centrifugal separation contain a certain amount of particles, however, which gradually deposit in the separation chamber of the centrifuge rotor. In a centrifuge rotor according to FIG. 6–8 such deposits of particles in the channels 56–59 and in the chamber 63 may be removed during rotation of the centrifuge rotor by rotation of the flexible member 55 180° around its longitudinal axis within the rotor body 54. A possibility for such a rotation has been described above in connection with FIG. 1–5.

Another possibility of rotating a flexible member of the kind described above within a rotor body is — when a rotation is desired — to give the rotor body temporarily a somewhat different speed than the relation 2:1 relative to the speed with which the part of the flexible member situated radially outside the rotor body is rotated. An arrangement for rotation of the flexible member in this manner is shown in FIG. 9.

In FIG. 9 there is shown a centrifugal separator designed principally in the same way as the centrifugal separator in FIG. 1. Details in FIG. 9 having direct counterparts in FIG. 1, therefore, have been given the same reference numerals as in FIG. 1 but with the addition of a letter b. In the following respects the centrifugal separator in FIG. 9 differs from the centrifugal separator in FIG. 1.

In FIG. 9 there is mounted within the casing lb on its bottom an extra motor 72. On its shaft there is mounted a gear wheel 73 which through a gear belt 74 is in driving engagement with another gear wheel 75 situated within the sleeve 3*b*. For the extension of the gear belt 74 the sleeve 3*b* has an opening in its surrounding wall.

The shaft 6*b* supporting the rotor body 15*b* has an axial through bore, through which there is extending a spindle 76 supporting at its lower end said gear wheel 75. At its upper end the spindle 76 supports a gear wheel 77, which through a gear belt 78 is in driving engagement with the gear wheel 20*b*. The sleeve 11*b* has an opening in its surrounding wall for the gear belt 78.

The spindle 76 with its gear wheels 75 and 77 is supported by and is rotatable relative to the hollow shaft 6*b*.

The sleeve 16*b* is firmly connected with the sleeve 11*b* by means of a separate member 79.

At the upper part of the casing 1*b* the flexible member 28*b* is in engagement with the sleeve 27*b* and can not be rotated relative thereto.

The centrifugal separator in FIG. 9 operates in the following manner: The motor 2 drives through the gear transmission 8*b*–10*b* the hollow shaft 6*b* and with this the cylindrical container 7*b*.

The sleeve 11*b*, which is firmly connected with the container 7*b*, brings the sleeve 16*b* in rotation around its own rotational axis C. As long as the gear wheel 77 is maintained still by means of the motor 72, there is obtained by the rotation of the sleeve 16*b* a rotation therein of the shaft 19*b* as a consequence of its driving engagement with the gear wheel 77 through the gear wheel 20*b* and the gear belt 78. The rotation of the shaft 19*b* is transferred to the rotor body 15*b* through the gear transmission 22*b*, 23*b*, so that the rotor body 15*b* rotates in the same direction but twice as fast as the container 7*b*.

The speed relation 2:1 between the rotor body 15*b* and the container 7*b* may be changed by starting the motor 72 and letting it give the gear wheel 77 a certain rotational speed. If this happens, the flexible member 28*b* will try to twist, however. Due to the fact that the flexible member at one of its ends is in engagement with the sleeve 27*b* the consequence will be that its other end portion, which is situated in the rotor body 15*b*, will perform a rotational movement around its own centre axis relative to the rotor body 15*b*.

We claim:

1. A centrifugal separator comprising a rotor body having an axis and two ends axially separated, a cavity in said rotor body, an elongated flexible member extending from a location at said axis outside one of said ends of the rotor body, around the outside periphery of the rotor body and into the rotor body at said axis at the other of said ends of the rotor body, the flexible member forming an elongated separation chamber positioned in said cavity of the rotor body and extending with its longitudinal axis in the circumferential direction of the rotor body, the flexible member further forming an inlet channel extending from the axis of the rotor body to an inlet part of the separation chamber and an outlet channel extending from an outlet part of the separation chamber to the axis of the rotor body, means for rotating the rotor body in a direction around the axis at a first velocity and for rotating the part of the flexible member situated outside the rotor body in the same direction around the same axis at a second velocity which is one-half of said first velocity, and means for rotating the flexible member around its own longitudinal axis during rotation of the rotor body such that the separation chamber is rotated in said cavity relative to the rotor body.

2. Centrifugal separator according to claim 1, wherein the the inlet and outlet channels extend beside each other all the way from said location outside the rotor, via the said other end of the rotor body, to said cavity of the rotor body, and in which two end portions of the channels extend in the circumferential direction of the rotor body and form respective parts of the separation chamber, the channels communicating with each other at their ends within the rotor body.

3. Centrifugal separator according to claim 2, wherein said flexible member comprises a longitudinal partition separating the channels, said partition terminating short of the end of the flexible member within the rotor body to form a connection between the channels.

4. Centrifugal separator according to claim 1, wherein the flexible member is surrounded substantially along the whole of its length, by a torsion stiff but flexible casing, which engages the flexible member such that the latter by means of the casing is rotatable around its longitudinal axis.

5. Centrifugal separator according to claim 4, wherein said flexible casing comprises at least a first reinforcement thread, which extends helically around the flexible member, and at least a second reinforcement thread, which extends helically around the flexible member with a pitch opposite to that of the first reinforcement thread, said reinforcement threads being plaited with each other.

6. Centrifugal separator according to claim 1, wherein the flexible member forms at least three parallel channels; one inlet channel extending from said location outside the rotor body and into the rotor body and forming the separation chamber, and two outlet channels extending from radially separated points at the outlet part of the separation chamber back to said location outside the rotor body.

7. Centrifugal separator according to claim 6, wherein the inlet channel extends a distance along the periphery of the rotor body such that it forms at least part of the separation chamber.

8. Centrifugal separator according to claim 7, wherein the inlet channel at the periphery of the rotor body opens in a chamber, from which the two outlet channels start, radially one at each side of the opening of the inlet channel.

* * * * *

UNITED STATES PATENT AND TRADEMARK OFFICE

CERTIFICATE OF CORRECTION

PATENT NO. : 4,950,401

DATED : August 21, 1990

INVENTOR(S) : Unger et al.

It is certified that error appears in the above-identified patent and that said Letters Patent is hereby corrected as shown below:

Col. 2, line 40, before "the separation chamber" insert -- a mixture supplied to--;

Claim 1, line 16, after "around", "the" should be --its--;

Signed and Sealed this

Twelfth Day of November, 1991

*Attest:*

HARRY F. MANBECK, JR.

*Attesting Officer*

*Commissioner of Patents and Trademarks*